US005219644A

United States Patent [19]

Lal et al.

[11] Patent Number: 5,219,644

[45] Date of Patent: Jun. 15, 1993

[54] TREATED POLYMER FABRICS

[76] Inventors: Kasturi Lal, 2993 Nantucket Dr., Willoughby, Ohio 44094; Richard M. Lange, 155 E. 207 St., Euclid, Ohio 44123

[21] Appl. No.: 494,642

[22] Filed: Mar. 15, 1990

[51] Int. Cl.[5] ..... D04H 13/00; D06M 13/322; D21H 27/00; C07C 229/00

[52] U.S. Cl. ..... 428/224; 8/115.6; 8/115.51; 8/194; 8/196; 162/158; 162/179; 252/8.6; 252/8.8; 252/8.9; 562/567; 562/555; 562/564; 428/272; 428/279; 428/289

[58] Field of Search ..... 428/224; 8/115.6, 115.51, 8/194, 196; 162/158, 179; 427/384, 394, 395; 252/8.6, 8.8, 8.9; 526/567, 555, 564; 260/400, 401

[56] References Cited

U.S. PATENT DOCUMENTS

| | | | |
|---|---|---|---|
| 3,329,608 | 7/1967 | Hiestaud | 252/8.8 |
| 3,973,068 | 8/1976 | Weber | 428/212 |
| 4,738,676 | 4/1988 | Osborn, III | 604/385 |
| 4,753,834 | 6/1988 | Braun et al. | 428/74 |
| 4,915,786 | 4/1990 | Sweeney | 162/158 |
| 4,957,645 | 9/1990 | Emert et al. | 252/47.5 |

*Primary Examiner*—George F. Lesmes
*Assistant Examiner*—Kathryne E. Shelborne

[57] ABSTRACT

This invention relates to an article comprising:
(A) at least one polymer fabric treated with (B) at least one wetting agent which comprises at least one compound of the formulae

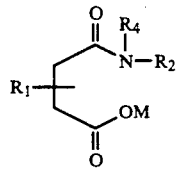

I or

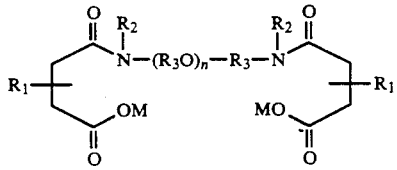

II wherein each $R_1$ is independently a hydrocarbyl group having from about 8 to about 150 carbon atoms; each $R_2$ is independently hydrogen, an alkyl group or polyoxyalkylene group; each $R_3$ is independently an alkylene group; $R_4$ is an alkyl group or polyoxyalkylene group; n is 1 to about 150; and M is a hydrogen, an ammonium cation or a metal cation.

The treated polymer fabrics of the present invention have improved wicking/wetting characteristics. Further, the fabrics maintain these characteristics upon repeated exposure to fluids.

39 Claims, No Drawings

TREATED POLYMER FABRICS

FIELD OF THE INVENTION

This invention relates to treated polymer fabrics.

BACKGROUND OF THE INVENTION

Polymer fabrics are extensively used in a wide variety of products, ranging from disposable towel sheets to sanitary napkins and from disposable diapers to surgical sponges. All these applications involve the absorption of water or aqueous liquids (urine, blood, lymph, spills of coffee, tea, milk, etc.). The fabrics must have good wicking properties, i.e., water must be readily taken up and spread.

Polymer fabrics are generally hydrophobic. It is desirable to improve the wicking wetting ability of the polymer fabrics. Often wetting agents are used to improve the ability of the polymer fabric to pass water and bodily fluids through the polymer fabric and into an absorbant layer. Further, it is desirable that the polymer fabric maintain its wicking/wetting characteristics after repeated exposure to water or aqueous liquids.

SUMMARY OF THE INVENTION

This invention relates to an article comprising:

(A) at least one polymer fabric treated with (B) at least one wetting agent which comprises at least one compound of the formulae

I

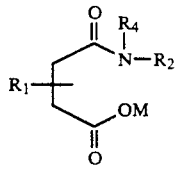

or

II

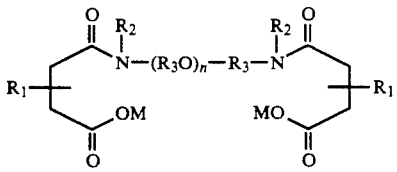

wherein each $R_1$ is independently a hydrocarbyl group having from about 8 to about 150 carbon atoms; each $R_2$ is independently hydrogen, an alkyl group or polyoxyalkylene group; each $R_3$ is independently an alkylene group; $R_4$ is an alkyl group or polyoxyalkylene group; n is 1 to about 150; and M is a hydrogen, an ammonium cation or a metal cation.

The treated polymer fabrics of the present invention have improved wicking/wetting characteristics. Further, the fabrics maintain these characteristics upon repeated exposure to aqueous fluids.

DESCRIPTION OF THE PREFERRED EMBODIMENTS

The polymer fabrics which are treated with wetting agents may be any polymer fabric, preferably a woven or nonwoven fabric, more preferably a nonwoven fabric. The polymer fabric may be prepared by any method known to those skilled in the art. When the fabric is nonwoven, it may be a spunbonded or melt-blown polymer fabric, preferably a spunbonded fabric. Spin-bonding and melt-blowing processes are known to those in the art.

The polymer fabric may be prepared from any thermoplastic polymer. The thermoplastic polymer can be a polyester, polyamide, polyurethane, polyacrylic, polyolefin, combinations thereof, and the like. The preferred material is polyolefin.

The polyolefins are polymers which are essentially hydrocarbon in nature. They are generally prepared from unsaturated hydrocarbon monomers. However, the polyolefin may include other monomers provided the polyolefin retains its hydrocarbon nature. Examples of other monomers include vinyl chloride, vinyl acetate, acrylic acid or esters, methacrylic acid or esters, acrylamide and acrylonitrile. Preferably, the polyolefins are hydrocarbon polymers. The polyolefins include homopolymers, copolymers and polymer blends.

Copolymers can be random or block copolymers of two or more olefins. Polymer blends can utilize two or more polyolefins or one or more polyolefins and one or more nonpolyolefin polymers. As a practical matter, homopolymers and copolymers and polymer blends involving only polyolefins are preferred, with homopolymers being most preferred.

Examples of polyolefins include polyethylene, polystyrene, polypropylene, poly(1-butene), poly(2-butene), poly(1-pentene), poly(2-pentene), poly(3-methyl-1-pentene), poly(4-methyl-1-pentene), poly-1,3-butadiene and polyisoprene, more preferably polyethylene an polypropylene.

The polymer fabric is treated with a wetting agent to improve the hydrophilic character of the fabric. The wetting agents of the present invention are compounds represented by the Formulae I or II described above.

Preferably each $R_1$ is independently a hydrocarbyl group having from about 8 to about 150 carbon atoms, more preferably from about 8 to about 100, more preferably from about 8 to about 50, more preferably from about 8 to about 30, more preferably about 8 to about 24, more preferably about 10 to 18. More preferably each $R_1$ is independently an alkyl group, an alkenyl group, a polyalkene group or mixtures thereof, more preferably each $R_1$ is independently an alkyl or alkenyl group. When $R_1$ is a polyalkene group, the polyalkene group is characterized as having a number average molecular weight (Mn) of about 400 to about 2000, more preferably 800 to about 1500, more preferably 900 to about 1100.

Preferably each $R_2$ is independently a hydrogen or an alkyl group having from 1 to about 20 carbon atoms, more preferably 1 to about 8. In a preferred embodiment, each $R_2$ is independently an alkyl group having from 1 to about 8 carbon atoms. Preferably each $R_2$ is independently a methyl, ethyl, propyl, butyl or amyl group, more preferably a butyl or amyl group.

Preferably $R_4$ is an alkyl group, or a polyoxyalkylene group. When $R_4$ is an alkyl group, it is defined the same as $R_2$. When $R_4$ is a polyoxyalkylene group, it is preferably a polyoxypropylene group or a polyoxypropylene-polyoxyethylene-polyoxypropylene group.

In another embodiment, the wetting agent is represented by Formula I, and $R_2$ is hydrogen and $R_4$ is a group having a tertiary carbon atom adjacent to the amino group. Preferably, $R_4$ is a tertiary aliphatic group having from about 4 to about 28, preferably 6 to about 24, more preferably 8 to about 24 carbon atoms. Preferably, $R_4$ is a tert-octyl, tert-dodecyl, tert-tetradecyl, tert-hexadecyl, or tert-octadecyl group.

In another embodiment, the wetting agent is represented by Formula I wherein $R_2$ is a hydrogen and $R_4$ is a polyoxyalkylene group. Preferably $R_4$ is a polyoxypropylene group or a polyoxypropylene-polyoxyethylene-polyoxypropylene group.

In another embodiment, the wetting agent is represented by Formula II, wherein $R_2$ is hydrogen or a methyl group, preferably hydrogen. Preferably, each $R_3$ is independently an alkylene group having from 2 to about 8, more preferably 2 to about 4, more preferably 2 or 3 carbon atoms. Preferably, each $R_3$ is independently an ethylene or propylene group.

Preferably, each $R_3$ is independently an alkylene group having from 2 to about 8 carbon atoms, more preferably 2 to about 4. Preferably each $R_3$ is independently an ethylene or propylene group.

Preferably each n is independently 1 to about 150, more preferably 2 to about 50, more preferably 2 to about 20, more preferably from about 3 to about 10.

The wetting agents used in the present invention are prepared by the reaction of at least one polycarboxylic acid or anhydride with at least one amine selected from the group consisting of a secondary amine, an amine terminated polyoxyalkylene and a tertiary aliphatic primary amine. The amines are selected so that an amidic acid is formed between the amine and polycarboxylic acid.

The polycarboxylic acids are carboxylic acids or anhydrides having from 2 to about 4 carbonyl groups. The polycarboxylic acids are preferably dimer acids, trimer acids or substituted succinic acids or anhydrides.

The dimer and trimer acids are the products resulting from the dimerization and trimerization of unsaturated fatty acids. Preferably the dimer acids are carboxylic acid products of the dimerization of $C_8$ to $C_{26}$ monomeric unsaturated fatty acids such as described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of the dimerized $C_8$ to $C_{26}$ monomeric unsaturated fatty acids include but are not limited to such products as Empol® 1014 Dimer Acid and Empol® 1016 Dimer Acid each available from Emery Industries, Inc.

In another embodiment, the polycarboxylic acids are diacids which are the carboxylic acid products of the Diels-Alder type reaction of an unsaturated fatty acid with alpha,beta-ethylenically unsaturated carboxy acid (e.g., acrylic, methacrylic, maleic or fumaric acids) such as are taught in U.S. Pat. No. 2,444,328, the disclosure of which is incorporated herein by reference, and the Diels-Alder adduct of a three to four carbon atom alpha,beta-ethylenically unsaturated alkyl monocarboxylic or dicarboxylic acid (e.g., acrylic and fumaric acids respectively) and pimeric or abietic acids. Examples of these diacids are Westvaco® Diacid 1525 and Westvaco® Diacid 1550, both are commercially available from the Westvaco Corporation.

In a preferred embodiment the polycarboxylic acids or anhydrides are succinic acids or anhydrides having a hydrocarbyl group. The hydrocarbyl group is defined the same as $R_1$.

In one embodiment the polycarboxylic acid or anhydride is an alkyl or alkenyl succinic anhydride. Preferably the succinic anhydride has an alkyl or alkenyl group having from about 8 to about 30 carbon atoms. The succinic acid or anhydride preferably has a octyl, decyl, dodecyl, tridecyl, tetradecyl, hexadecyl, octadecyl, dodecnyl, tetradecenyl, hexadecenyl, octadecenyl, oleyl or soya group. Preferably, the alkyl or alkenyl group will be derived from monoolefins having from about 2 to about 30 carbon atoms or oligomers of olefins having less than 7 carbon atoms, preferably ethylene, propylene or butylene. Preferably, the group is a propylene tetramer group. The alkyl or alkenyl group may be derived from mixtures of monoolefins.

In another embodiment, the hydrocarbyl group is a polyalkene group having an Mn value as defined for $R_1$. The polyalkene group is a homopolymer or an interpolymer of polymerizable olefin monomers of 2 to about 16 carbon atoms, preferably 2 to about 6 carbon atoms, more preferably 3 or 4 carbon atoms. The interpolymer is one in which 2 or more olefin monomers are interpolymerized according to well known conventional procedures to form polyalkenes. The monoolefins are preferably ethylene, propylene, butylene, or octylene with butylene preferred. A preferred polyalkene group is a polybutenyl group. The above succinic acids and anhydrides having a polyalkene group are disclosed in U.S. Pat. No. 4,234,435, issued to Meinhardt et al. The patent is incorporated by reference for its disclosure of these succinic acids and anhydrides as well as procedures for making the same.

The polyalkene substituted carboxylic acids may be used in combination with fatty alkyl or alkenyl substituted carboxylic acids. The fatty groups are those having from about 8 to about 30 carbon atoms. It is preferred that the polyalkene substituted carboxylic acids and the fatty substituted carboxylic acids are preferably used in mixtures of a equivalent ratio of from about (0–1.5:1), more preferably about (0.5–1:1), more preferably about (1:1).

The above carboxylic acids or anhydrides are reacted with an amine which will form the amidic acid as described herein. The amine useful in making the amidic acid may be a secondary amine, an amine terminated polyoxyalkylene or a tertiary aliphatic primary amine.

The secondary amine is preferably a secondary cycoalkyl or alkyl amine. Each alkyl group independently has from 1 to about 28 carbon atoms, preferably 3 to about 12, more preferably 1 to about 6. Each cycloalkyl group independently contains from 4 to about 28 carbon atoms, more preferably 4 to about 12, more preferably 5 to about 8. Examples of cycloalkyl and alkyl groups include methyl, ethyl, propyl, butyl, amyl, hexyl, heptyl, octyl, cyclopentyl, cyclohexyl, cycloheptyl or cyclooctyl groups. Preferred secondary alkyl amines include but are not limited to dipropyl amine, dibutyl amine, diamyl amine, dicyclohexylamine and dihexylamine.

The amine terminated polyoxyalkylene and tertiary aliphatic primary amine are primary amines which contain a secondary or tertiary carbon atom adjacent to the nitrogen. The substituted carbon atom adjacent to the nitrogen provides stearic hindrance which impedes imide formation.

In one embodiment, the primary amine is a tertiary-aliphatic primary amine having from about 4 to about 30, preferably about 6 to about 24, more preferably about 8 to about 24, carbon atoms in the aliphatic group. Usually the tertiary aliphatic primary amines are monoamines represented by the formula

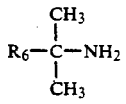

wherein $R_6$ is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary aliphatic primary amines and "Primene JMT" which is a similar mixture of $C_{18}$–$C_{22}$ tertiary aliphatic primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are in U.S. Pat. No. 2,945,749 which is hereby incorporated by reference for its teaching in this regard.

In another embodiment the primary amine is amine terminated polyoxyalkylene; such as an amino polyoxypropylene-polyoxyethylene-polyoxypropylene, or an amino polyoxypropylene. These amines are generally prepared by the reaction of a monohydric alcohol with an epoxide, such as styrene oxide, 1,2-butene oxide, ethylene oxide, propylene oxide and the like, more preferably ethylene oxide, propylene oxide or mixtures thereof. The terminal hydroxyl group is then converted to an amino group. These amines are represented by the structure:

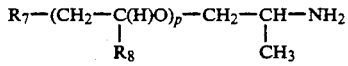

wherein p is 1 to about 150, $R_7$ is an alkoxy group having 1 to about 18 carbon atoms, and each $R_8$ is independently hydrogen or an alkyl group. Preferably p is 1 to 100, more preferably about 4 to about 40. Preferably each $R_8$ is independently hydrogen or an alkyl group having from 1 to 4 carbon atoms, more preferably hydrogen or a methyl group. $R_7$ is preferably an alkoxy group having from 1 to 12 carbon atoms, more preferably a methoxy group. These types of amines are available from Texaco Chemical Company under the tradename Jeffamine. Specific examples of these amines include Jeffamine® M-600; M-1000, M-2005 and M-2070 amines.

In another embodiment, the amine terminated polyoxyalkylene is a diamine such as preferably amine terminated polypropylene glycols. These diamines are represented by the formula

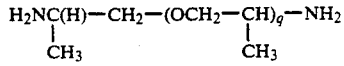

wherein q is from 1 to about 150, preferably 2 to about 100, more preferably 2 to about 75. Examples of these amines include Jeffamine® D-230 wherein q is about 2-3;, Jeffamine® D-400 wherein q is about 5-6, Jeffamine® D-2000 wherein q is an average of about 33, and Jeffamine® D-4000 wherein q is an average of about 68.

In another embodiment, the diamines are represented by the formula

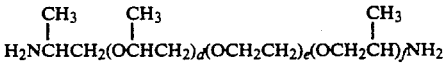

wherein d is a number in the range of from zero to about 200; e is a number in the range of form about 10 to about 650; and f is a number in the range of from zero to about 200. These diamines preferably have number average molecular weights in the range of about 600 to about 6,000, more preferably about 600 to about 2,000. Specific examples of the diamines include Jeffamine® ED-600 wherein d+f is approximately 2.5 and e is approximately 8.5; Jeffamine® ED-900 wherein d+f is approximately 2.5 and e is approximately 15 5; and Jeffamine® ED-2001 wherein d+f is approximately 2.5 and e is approximately 40.5.

In another embodiment, the diamines are represented by the formula

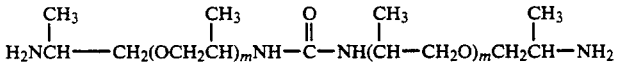

wherein m is a number sufficient to provide said compound with a number average molecular weight of at least about 600. These compounds preferably have number average molecular weights in the range of about 600 to about 2,500, more preferably about 700 to about 2,200.

In another embodiment, the amine terminated polyoxyalkylene is a triamine prepared by treating a triol with ethylene oxide, propylene oxide, or mixtures thereof, followed by amination of the terminal hydroxyl group. These amines are available commercially from Texaco Chemical Company under the tradename Jeffamine® triamines. Examples of these amines include, Jeffamine® T-403, which is trimethylolpropane treated with about 5-6 moles of propylene oxide, Jeffamine® T-3000, which is glycerine treated with 50 moles of propylene oxide, and Jeffamine® T-5000, which is glycerine treated with 85 moles of propylene oxide.

The diamines and triamines that are useful in accordance with the present invention are disclosed in U.S. Pat. Nos. 3,021,232; 3,108,011; 4,444,566; and Re. 31,522. The disclosures of these patents are incorporated herein by reference.

The above amines are reacted with the above polycarboxylic acid to form the amidic acids of the present invention. The process for preparing the amidic acids involves reacting the polycarboxylic acids with an amine at a equivalent ratio of about (2–4:1), more preferably (2:1), at room temperature to just below the temperature of imide formation, more preferably room temperature to 150° C., more preferably room temperature to 135° C. The reaction is usually accomplished within four hours, more preferably between 0.25 to about 2 hours.

The amidic acids prepared as described above may be used as wetting agents to treat the polymer fabric. The wetting agent may be an amidic acid or salt.

When the wetting agents are used as salts, each M in Formulae I or II is independently an ammonium cation or metal cation.

When M is a metal cation, the metal cation may be an alkali metal, alkaline earth metal or transition metal cation, preferably an alkali metal or an alkaline earth metal cation, more preferably an alkali metal cation. Specific examples of metal cations include sodium, potassium, calcium, magnesium, zinc or aluminum cation, more preferably, a sodium or potassium cation. The metal cations are formed by treating an amidic acid with a metal oxide, hydroxide, or halide. The metal salt is formed between room temperature and about 120° C., more preferably room temperature to about 80° C.

When M is an ammonium cation, the ammonium cation may be derived from ammonia or any amine. The amine useful in making ammonium salts of amidic acids may be any of the amines used in forming the amidic acid. Further, the amine may be an alkyl monoamine, or a hydroxyamine.

The alkyl monoamines are primary, secondary or tertiary monoamines. The alkyl monoamines generally contain from 1 to about 24 carbon atoms, more preferably 1 to about 12, more preferably 1 to about 6 in each alkyl group. Examples of primary monoamines useful in the present invention include methylamine, ethylamine, propylamine, butylamine, octylamine, and dodecylamine. Examples of secondary monoamines are given above. Tertiary monoamines include trimethylamine, tributylamine, methyldiethylamine, ethyldibutylamine, etc.

In another embodiment the amines are hydroxyamines. Typically, the hydroxyamines are primary, secondary or tertiary alkanol amines or mixtures thereof. Such amines can be represented by the Formulae:

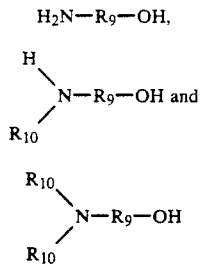

wherein each $R_{10}$ is independently a hydrocarbyl group of one to about eight carbon atoms or hydroxyhydrocarbyl group of two to about eight carbon atoms and $R_9$ is a divalent hydrocarbyl group of about two to about 18 carbon atoms. The group —$R_9$—OH in such formulae represents the hydroxyhydrocarbyl group. $R_9$ can be an acyclic, alicyclic or aromatic group. Typically, $R_9$ is an acyclic straight or branched alkylene group such as an ethylene, 1,2-propylene, 1,2-butylene or 1,2-octadecylene group, more preferably an ethylene or propylene group, more preferably an ethylene group. Where two $R_{10}$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R_{10}$ is independently a methyl, ethyl, propyl, butyl, pentyl or hexyl group.

Examples of these hydroxyamines include monoethanol amine, diethanol amine, triethanol amine, diethylethanol amine, ethylethanol amine, etc.

The hydroxyamines can also be an ether N-(hydroxyhydrocarbyl)amine. These are hydroxypoly(hydrocarbyloxy) analogs of the above-described hydroxyamines (these analogs also include hydroxyl-substituted oxyalkylene analogs). Such N-(hydroxyhydrocarbyl amines can be conveniently prepared by reaction of epoxides with afore-described amines and can be represented by the Formulae:

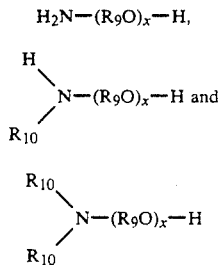

wherein x is a number from about 2 to about 15 and R and $R_9$ are as described above. $R_{10}$ may also be a hydroxypoly(hydrocarbyloxy) group.

In a preferred embodiment, the salts of the amidic acids are formed from hydroxyamines. These hydroxyamines can be represented by the formula

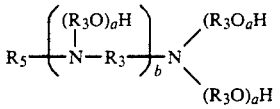

wherein each $R_3$ is an alkylene group; $R_5$ is a hydrocarbyl group; a is independently an integer from zero to 100, provided at least one a is an integer greater than zero; and b is zero or one.

Preferably, $R_5$ is a hydrocarbyl group having from 8 to about 30 carbon atoms, preferably 8 to about 24, more preferably 10 to about 18 carbon atoms. $R_5$ is preferably an alkyl or alkenyl group, more preferably an alkenyl group. $R_5$ is preferably an octyl, decyl, dodecyl, tridecyl, tetradecyl, hexadecyl, octadecyl, oleyl, tallow or soya.

a is preferably one to about 100, more preferably 2 to about 50, more preferably 2 to about 20, more preferably 3 to about 10, more preferably about 5.

$R_3$ is as described above. Preferably, each $R_3$ is independently an ethylene or propylene group.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 8 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where b in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroxyethyl)oleylamine, and mixtures thereof. Also included are the comparable members wherein in the above formula at least one a is an integer greater than 2, as for example, 2-hydroxyethoxyethylhexylamine.

A number of hydroxyamines wherein b is zero are available from the Armak Chemical Division of Akzona, Inc., Chicago, Ill., under the general trade designation "Ethomeen" and "Propomeen". Specific examples of such products include "Ethomeen C/15" which is an ethylene oxide condensate of a cocoamine containing about 5 moles of ethylene oxide; "Ethomeen C/20" and "C/25" which also are ethylene oxide condensation products from cocoamine containing about 10 and 15 moles of ethylene oxide respectively; "Ethomeen 0/12" which is a ethylene oxide condensation product of oleylamine containing about 2 moles of ethylene oxide per mole of amine. "Ethomeen S/15" and "S/20" which are ethylene oxide condensation products with soyaamine containing about 5 and 10 moles of ethylene oxide per mole of amine respectively; and "Ethomeen T/12, T/15" and "T/25" which are ethylene oxide condensation products of tallowamine containing about 2, 5 and 15 moles of ethylene oxide per mole of amine respectively. "Propomeen O/12" is the condensation product of one mole of oleyl amine with 2 moles propylene oxide. Preferably, the salt is formed from Ethomeen C/15 or S/15 or mixtures thereof.

Commercially available examples of hydroxyamines where b is one include "Ethoduomeen T/13" and "T/20" which are ethylene oxide condensation products of N-tallow trimethylene diamine containing 3 and 10 moles of ethylene oxide per mole of diamine, respectively.

The fatty polyamine diamines include mono- or dialkyl, symmetrical or asymmetrical ethylene diamines, propane diamines 1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen O" (N-oleyl-1,3-diaminopropane). "Duomeens" are commercially available diamines described in Product Data Bulletin No. 7-10R1 of Armak Chemical Co., Chicago, Ill. In another embodiment, the secondary amines may be cyclic amines such as piperidine, piperazine, morpholine, etc.

The following examples relate to amidic acids and salts which are useful as wetting agents in the present invention. In the examples, all parts are expressed in parts by weight. Neutralization number is the amount of potassium hydroxide required to neutralize one gram of sample. Neutralization number is expressed in milligrams of potassium hydroxide or mg KOH. Unless otherwise indicated, the reaction temperature is ambient temperature.

EXAMPLE 1

A reaction vessel, equipped with a stirrer, thermometer, reflux condensor and addition funnel is charged with 269 parts of tetrapropenyl-substituted succinic anhydride. Then 374 parts Primene 81R (a mixture of $C_{12-14}$ t-alkyl primary amines available commercially from Rohm & Hass Co.) are added dropwise over 3 hours. The reaction is exothermic and the temperature of the reactant increases from room temperature to about 59° C. over the course of the amine addition. Stirring is continued for an additional hour at 55° C. After cooling to 40° C. the material is filtered and collected.

EXAMPLE 2

A reaction vessel, equipped as described in Example 1, is charged with 508 parts (2.0 moles) of tetrapropenyl-substituted succinic anhydride. The succinic anhydride is heated to 95° C., and 277 parts (2.1 moles) of dibutyl amine is added dropwise over 2 hours. The reaction is maintained at 95° C. for 1 hour and cooled to room temperature. The product has 3.8% nitrogen and a neutralization number to phenolphthalein of 143 mg KOH.

EXAMPLE 3

A vessel, equipped as described in Example 1, is charged with 133 parts (0.5 mole) of tetrapropenyl-substituted succinic anhydride, 300 parts (0.5 mole) of Jeffamine M600, and 200 parts of xylene. The reaction mixture is heated to 135° C. under stirring. The temperature is maintained between 135° and 145° C. for 3 hours. Three and one-half milliliters of water is collected. The reaction is vacuum stripped to 135° C. and 10 millimeters of mercury. The residue is cooled to room temperature. The residue is a dark orange liquid which has 1.7% nitrogen.

EXAMPLE 4

A reaction vessel is charged with 288 parts (0.33 mole) of the product of Example 3 and 141 parts (0.33 mole) of Ethomeen C-15. The mixture is stirred for 10 minutes. The product is an orange clear liquid which has 2.2% nitrogen.

EXAMPLE 5

A reaction vessel is charged with 98 parts (0.25 mole) of the product of Example 2 and 101 parts (0.25 mole) of Ethomeen S/15. The mixture is stirred for 15 minutes. The product is an orange liquid having 3.2% nitrogen and a neutralization number to phenolphthalein of 58.2 mg KOH.

EXAMPLE 6

A reaction vessel is charged with 1064 parts (4.0 moles) of a tetrapropenyl-substituted succinic anhydride. Then, 640 parts (4.0 moles) of diamyl amine is added dropwise over 1.25 hours. The reaction is exothermic and the temperature rises to 57° C. from room temperature. The reaction mixture is then heated to 100° C. and held for 1.50 hours. The reaction mixture is cooled to 70° C. and 1193 parts (2.8 moles) of Ethomeen C/15 and 456 parts (0.9 moles) Ethomeen S/15 are added dropwise. The mixture is stirred for 15 minutes and an orange clear liquid product is obtained. The product has 3.28% nitrogen and a neutralization number to phenolphthalein of 67.5 mg KOH.

EXAMPLE 7

A reaction vessel is charged with 58 parts (0.12 mole) of an amidic acid, prepared by reacting a tetrapropenyl succinic anhydride with a Jeffamine D-400 at a (2:1) equivalent ratio, and having a neutralization number to phenolphthalein of 119.5 mg KOH and a percent nitrogen of 2.8%, and 16.1 parts (0.12 mole) of dibutylamine. The reaction mixture is heated to 50° C. and stirred for 50 minutes. The product is an orange-yellow syrup having a neutralization number to phenolphthalein of 99.5 mg KOH and 4.5% nitrogen.

EXAMPLE 8

A reaction vessel is charged with 33 parts (0.13 mole) of a tetrapropenyl succinic anhydride, 140 parts (0.13 mole) of a polybutenyl succinic anhydride wherein the polybutenyl group has a number average molecular weight of about 950, and 50 parts (0.13 mole) of Jeffamine D-400. The mixture is stirred for 15 minutes. The reaction temperature rose to 80° C. The reaction mixture is heated to 100° C. for 45 minutes and stirred for 10 minutes. This intermediate product has a neutralization number to phenolphthalein of 74.2 mg KOH. Ethomeen C/15 (114 parts, 0.27 mole) is added to the vessel. The reaction mixture is stirred for 15 minutes. The product has a neutralization number to phenolphthalein of 48.7 mg KOH and has 2.1% nitrogen.

EXAMPLE 9

A reaction vessel, equipped as described in Example 1, is charged with 280 parts (0.25 mole) of the polyisobutenyl succinic anhydride described in Example 8. The succinic anhydride is heated to 75° C. and the 40 parts (0.25 mole) of diamyl amine are added dropwise over 1 hour and 15 minutes. The reaction mixture is heated to 105° C. and the temperature is maintained for 1¼ hours. This intermediate product has a neutralization number to phenolphthalein of 62.1 mg KOH. Then 162 parts (0.25 mole) of Ethomeen C/20 are added at 82° C. and the reaction mixture is stirred for 15 minutes. The product is cooled to room temperature. The product has a neutralization number to phenolphthalein of 67.1 mg KOH, and 1.23% nitrogen.

EXAMPLE 10

A reaction vessel is charged with 39 parts (0.1 mole) of an amidic acid prepared from a tetrapropenyl succinic anhydride and dibutyl amine and having a neutralization acid number to phenolphthalein of 143.5 mg KOH. Diethanol amine (10.6 parts, 0.1 mole) is added dropwise over 2 minutes, with stirring. The reaction mixture is stirred at room temperature for 15 minutes. The product has a neutralization acid number to phenolphthalein of 111 mg KOH and 5.77% nitrogen.

The wetting agents of the present invention are usually applied to the fabric as a 0.25 to about 2%, more preferably 0.5 to about 1%, more preferably 0.5 to about 0.75% by weight organic or aqueous mixture. The mixture may be a solution or dispersion. The organic mixture may be prepared by using volatile organic solvents. Useful organic solvents include alcohols, such as alcohols having from 1 to about 6 carbon atoms, including butanol and hexanol; or ketones, such as acetone or methylethylketone. Preferably the wetting agents are applied as an aqueous solution or dispersion. The wetting agents may be applied either by spraying the fabric or dipping the fabric into the mixture. After application of the wetting agents, the treated fabric is dried by any ordinary drying procedure such as drying at 120° C. for approximately 3 to 5 minutes.

A cowetting agent may be used to reduce wetting time of the above aqueous mixture. The cowetting agent is preferably a surfactant, more preferably a nonionic surfactant, more preferably a nonionic surfactant. Useful surfactants include the above described alkyl terminated polyoxyalkylenes, and alkoxylated phenols. Preferably, the surfactant is an alkyl terminated polyoxyalkylene.

The wetting time of the wetting agent mixture may also be reduced by heating the mixture. Usually the wetting agents are applied at room temperature. However, a 10°-15° C. increase in temperature significantly reduces wetting time.

Preferably, after drying the treated polymer fabrics contain from about 0.1 to about 3%, more preferably about 0.1 to about 1%, more preferably 0.5 to about 0.8% pickup. Percent pickup is the percentage by weight of wetting agent on a polymer fabric.

The following Table contains examples of polypropylene fabrics treated with aqueous solutions or dispersions of wetting agents. The polymer fabric may be any polypropylene fabric available commercially. The aqueous solution or dispersion contains a wetting agent in the amount shown in the Table. The polypropylene fabric is dipped into the aqueous solution or dispersion and then dried for 3-5 minutes at 125° C.

TABLE

| Examples | Wetting Agent | Amount Wetting Agent In Water |
|---|---|---|
| A | Example 1 | 1% |
| B | Example 3 | 0.75% |
| C | Example 6 | 0.5% |
| D | Example 8 | 0.75% |

The treated polymer fabrics have improved hydrophilic character. The treated fabrics show an improvement in the wicking/wetting ability. The polymer fabrics of the present invention may be formed into diapers, feminine products, surgical gowns, breathable clothing liners and the like by procedures known to those in the art.

The properties of the treated fabrics or products made with the fabrics may be measured by ASTM Method E 96-80, Standard Test Methods for Water Vapor Transmission of Materials, and INDA Standard Test 80 7-70 (82), INDA Standard Test for Saline Repellency of Nonwovens, often referred to as the Mason Jar Test. The later test uses a 0.9% by weight saline solution.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An article comprising:

(A) at least one hydrophobic polymer fabric treated with (B) at least one wetting agent which comprises at least one compound of the formulae

I

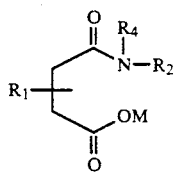

or

II

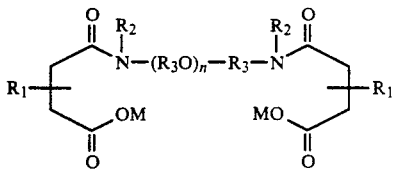

wherein each $R_1$ is independently a hydrocarbyl group having from about 8 to about 150 carbon atoms; each $R_2$ is independently hydrogen, an alkyl group or polyoxyalkylene group; each $R_3$ is independently an alkylene group; $R_4$ is an alkyl group or polyoxyalkylene group; n is 1 to about 150; and M is a hydrogen, an ammonium cation or a metal cation.

2. The article of claim 1, wherein $R_1$ is an alkyl or alkenyl group having from about 8 to about 30 carbon atoms; a polyalkene group having a number average molecular weight from about 400 to about 2000, or mixtures thereof.

3. The article of claim 1, wherein $R_1$ is an alkyl or alkenyl group having from about 8 to about 24 carbon atoms.

4. The article of claim 1, wherein $R_1$ is a polyalkene group having a number average molecular weight from about 900 to about 1100.

5. The article of claim 1, wherein $R_2$ is hydrogen and $R_4$ is a polyoxyalkylene group.

6. The article of claim 1, wherein each $R_2$ and $R_4$ is independently an alkyl group having from 1 to about 28 carbon atoms.

7. The article of claim 1, wherein each $R_3$ is independently an alkylene group having from 2 to about 8 carbon atoms, and n is from 2 to about 20.

8. The article of claim 1, wherein M is an ammonium cation derived from a hydroxy amine represented by the formula

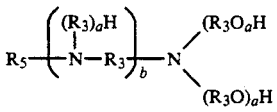

wherein $R_5$ is an alkyl or alkenyl group; each $R_3$ is independently an alkylene group; each a is independently an integer from zero to about 100 provided at least one a is an integer greater than zero; and b is zero or one.

9. The article of claim 8, wherein each $R_3$ is independently ethylene or propylene; $R_5$ is an alkyl or alkenyl group having from 8 to about 30 carbon atoms; a is an integer from about 2 to about 20; and b is zero.

10. The article of claim 8, wherein $R_5$ is an octyl, decyl, dodecyl, tridecyl, tetradecyl, hexadecyl, octadecyl, oleyl, tallow or soya group.

11. The article of claim 1, wherein M is hydrogen.

12. The article of claim 1, wherein M is a metal cation.

13. The article of claim 1, wherein M is a sodium, potassium, calcium, magnesium, zinc or aluminum cation.

14. The article of claim 1, wherein the compound is represented by Formula I, wherein each $R_1$ is independently an alkenyl or alkyl group having from about 8 to about 150 carbon atoms; each $R_2$ and $R_4$ is independently an alkyl group having from 1 to about 28 carbon atoms; and M is an ammonium cation.

15. The article of claim 14, wherein M is an ammonium cation derived from a hydroxy amine represented by the formula

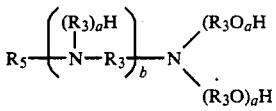

wherein $R_5$ is an alkyl or alkenyl group; each $R_3$ is independently an alkylene group; each a is independently an integer from zero to about 100 provided at least one a is an integer greater than, zero; and b is zero or one.

16. The article of claim 15, wherein each $R_3$ is independently ethylene or propylene, $R_5$ is an alkyl or alkenyl group having from 8 to about 30 carbon atoms, a is an integer from about 2 to about 20 and b is zero.

17. The article of claim 1, wherein the polymer fabric (A) is nonwoven.

18. The article of claim 1, wherein the polymer fabric (A) is a polyethylene or polypropylene fabric.

19. An article, comprising:

(A) at least one hydrophobic polymer fabric treated with (B) a wetting agent which comprises at least one amidic acid or salt thereof prepared by the reaction of (i) at least one hydrocarbyl substituted polycarboxylic acid or anhydride having a hydrocarbyl group containing from about 8 to about 150 carbon atoms with (ii) at least one amine selected from the group consisting of a secondary amine, an amine terminated polyoxyalkylene and a tertiary aliphatic primary amine.

20. The article of claim 19, wherein the polycarboxylic acid is selected from the group consisting of a hydrocarbyl substituted succinic acid or anhydride, a dimer acid and a trimer acid.

21. The article of claim 19, wherein the hydrocarbyl group is an alkyl or alkenyl group containing from about 8 to about 30 carbon atoms; a polyalkene group having a number average molecular weight from about 400 to about 2000, or mixtures thereof.

22. The article of claim 19, wherein the hydrocarbyl group is an alkyl or alkenyl group containing from about 8 to about 24 carbon atoms.

23. The article of claim 19, wherein the hydrocarbyl group is a polyalkene group having a number average molecular weight from about 900 to about 1100.

24. The article of claim 19, wherein the amine is a secondary amine selected from the group consisting of a secondary alkyl amine having from 3 to about 28 carbon atoms; and a secondary amine having a polyoxyalkylene, hydroxypolyoxyalkylene or alkanol group.

25. The article of claim 19, wherein the amine is a secondary alkyl amine having at least one butyl, amyl, hexyl or heptyl group or mixtures thereof.

26. The article of claim 19, wherein the amine is an amine terminated polyoxypropylene, or an amine terminated polyoxypropylene-polyoxyethylene-polyoxypropylene.

27. The article of claim 19, wherein the amine is tertiary aliphatic primary amine containing from about 4 to about 28 carbon atoms.

28. The article of claim 19, wherein the amine is a tertiary aliphatic primary amine wherein the alkyl group is tert-octyl, tert-dodecyl, tert-tetradecyl, tert-hexadecyl or tert-octadecyl group.

29. The article of claim 19, wherein the wetting agent is an amidic salt derived from a hydroxy amine represented by the formula

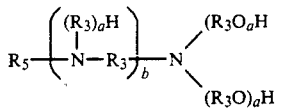

wherein $R_5$ is an alkyl or alkenyl group; each $R_3$ is independently an alkylene group; each a is independently an integer from zero to about 100 provided at least one a is an integer greater than zero; and b is zero or one.

30. The article of claim 29, wherein each $R_3$ is independently ethylene or propylene; $R_5$ is an alkyl or alkenyl group having from 8 to about 30 carbon atoms; a is an integer from about 2 to about 20; and b is zero.

31. The article of claim 19, wherein (i) is reacted with (ii) at a equivalent ratio of from about (1.5–4:1).

32. The article of claim 19, wherein the polymer fabric (A) is nonwoven.

33. The article of claim 19, wherein the polymer of the fabric is polyethylene or polypropylene.

34. The article of claim 19 wherein the polymer fabric is a polypropylene or polyethylene nonwoven fabric; (i) the hydrocarbyl substituted polycarboxylic acid or anhydride is an alkenyl succinic acid or anhydride having from about 8 to about 30 carbon atoms in the alkenyl group; (ii) the amine is at least one secondary alkyl amine independently having from 2 to about 12 carbon atoms in each alkyl group; the wetting agent is a salt derived from an alkoxylated amine which is an ethoxylated or propoxylated tallow amine, cocoamine, soyaamine, or oleylamine; and (i) is reacted with (ii) at an equivalent ratio of about (2:1).

35. The article of claim 19, wherein the amine is a diamyl or dibutyl amine and the polycarboxylic acid or anhydride is a dodecyl succinic acid or anhydride.

36. A process for improving wettability of a hydrophobic polymer fabric comprising treating the fabric with at least one wetting agent which comprises at least one compound of the formulae

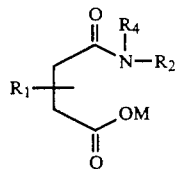

I or

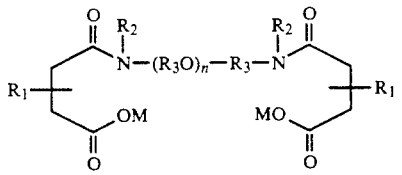

II wherein each $R_1$ is independently a hydrocarbyl group having from about 8 to about 150 carbon atoms; each $R_2$ is independently hydrogen, an alkyl group or polyoxyalkylene group; each $R_3$ is independently an alkylene group; $R_4$ is an alkyl group or polyoxyalkylene group; n is 1 to about 150; and M is a hydrogen, an ammonium cation or a metal cation.

37. A diaper prepared from the article of claim 1.

38. A diaper prepared from the article of claim 19.

39. A diaper prepared from the article of claim 35.

* * * * *